United States Patent [19]

Friedman

[11] 4,043,064

[45] Aug. 23, 1977

[54] COPYHOLDER

[76] Inventor: Gershon Friedman, Seestrasse 34, 8803 Ruschlikon, Switzerland

[21] Appl. No.: 615,090

[22] Filed: Sept. 19, 1975

[30] Foreign Application Priority Data

Sept. 26, 1974 Switzerland ..... 13017/74

[51] Int. Cl.[2] ..... B41J 11/44; B41J 29/00

[52] U.S. Cl. ..... 40/343; 197/181.2

[58] Field of Search ..... 35/9 A, 35 B; 40/341, 40/342, 343, 348, 349, 352; 197/180, 181.1, 181.2

[56] References Cited

U.S. PATENT DOCUMENTS

| | | | |
|---|---|---|---|
| 3,316,661 | 5/1967 | Simpson et al. | 35/35 B |
| 3,341,951 | 9/1967 | Barnette | 35/35 B |
| 3,344,534 | 10/1967 | Anschutz et al. | 35/9 A |
| 3,369,313 | 2/1968 | Vincent | 40/343 |
| 3,449,849 | 6/1969 | Di Pasquale et al. | 40/343 |
| 3,524,268 | 8/1970 | Venturi | 35/35 B |
| 3,744,157 | 7/1973 | Dallas | 40/352 X |
| 3,763,989 | 10/1973 | Goldman | 197/181.2 |
| 3,882,620 | 5/1975 | Grindle | 40/343 |

*Primary Examiner*—Anton O. Oechsle
*Assistant Examiner*—Vance Y. Hum
*Attorney, Agent, or Firm*—Cushman, Darby & Cushman

[57] ABSTRACT

A copyholder that is operable efficiently both with copy having regular lines and copy having irregular lines. A first actuating device moves an indicator over copy in an adjustable but predetermined and regular manner so that copy having regular lines may be readily copied, while a second actuating device independent of the first actuating device moves the indicator continuously as long as it is actuated so that copy having irregularly spaced lines may also be readily copied. A stopping device associated with the first actuating device compares actual-value signals with a predetermined rated-value signal to determine when movement of the indicator should be automatically terminated in copying material having regularly spaced lines.

6 Claims, 8 Drawing Figures

COPYHOLDER

BACKGROUND OF THE INVENTION

This invention relates to a copyholder with an indicator designed for movement relative to the copy area, an electrical drive and several actuating means for effecting the said relative movement.

Copyholders designed to accept copy, such as a manuscript, are known in which the relative displacement between indicator and copy is effected by means of an electric motor drive. Provided for actuation of the motor is an actuating means locally remote from the copyholder which is commonly designed as a manual or pedal switch (e.g. British Patent No. 859.135, Austrian Patent No. 220.171). Pressure exercised on the switch of the known apparatus moves the indicator until it has reached the target line. Subsequently pressure on the switch is discontinued for processing, such as for copying the line indicated. It will be appreciated that such copyholders involve disadvantages for the person who processes the copy. The continual shifting of the eyes from the machine operated to the copyholder interrupts the progress of writing, demands a high degree of concentration and is therefore not rational. Narrow-spaced manuscripts of some length may therefore result in fatigue symptoms so that actuation of the switch is no longer properly assessed and lines are e.g. skipped. Such apparatus are also used to train for high reading rates.

Further copyholders are known in which advance is effected not electrically but by the effect of gravity or by a string line (e.g. German Patent No. 827.955) and in which the indicator advances only one step upon actuation. Apart from the uncertain drive, such apparatus involve considerable disadvantages in practice because adjustment of the advance interval is commonly complicated. These known apparatus disadvantageously also do not permit continuous advance of the indicator which is desired for reading material with varying successive sections.

While eliminating the above disadvantages, the invention has for its object to provide a copyholder with which line advance can be actuated with minimum distraction from the machine operated, by way of example a typewriter, while at the same time ensuring that no lines of the copy are skipped. The advance interval and stroke respectively must be capable of being discretionally selected in order to enable the indicator to be effortlessly adjusted for any line spacing. In addition, it is to be ensured that intervals frequently employed, by way of example millimeter intervals or standardized typewriter line spaces, can be preselected and reproduced. Moreover, it must be possible, if desired, to move the indicator continuously from the end of one paragraph to the beginning of the one next following.

Accordingly the invention relates to a copyholder with a copy located thereon, an indicator arranged for movement relative to the copy surface, electrical driving means and several actuating means, characterized

- by a control unit connected to the driving means which sets the driving means in motion on receipt of a starting signal from a first actuating means,
- by a stopping device connected to the control unit for the automatic issuance of a stopping order to the control unit for stopping the driving means and a design of the driving means and the stopping means of the type that enables relative movements of discretional predetermined length to be effected,

- and by a second actuating means connected to the control unit for the selective issuance of starting orders and stopping orders independent of the stopping device.

BRIEF DESCRIPTION OF THE DRAWINGS

A number of embodiments will now be described in greater detail with reference to the drawing in which.

DETAILED DESCRIPTION OF THE INVENTION

Figure 1:
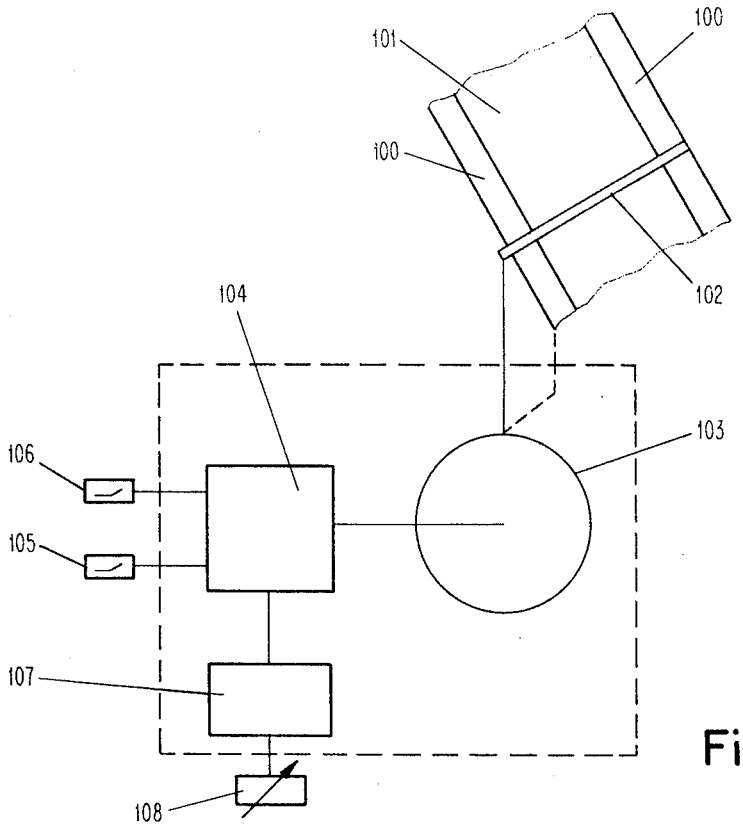
FIG. 1 is a schematic block diagram of the copyholder.

FIG. 1 schematically shows a simplified block diagram of the essential components of a generalized copyholder. A portion of the supporting surface 100 for the copy 101 to be copied or read is shown. The indicator 102 rests on the copy 101. Provided for actuation of the relative movement between the indicator 102 and the copy 101 and the supporting surface 100 respectively is the electrical driving means 103. In this embodiment the supporting surface is assumed to be stationary and the driving means 103 is drivingly connected to the indicator 102. However, the invention is also suitable for copyholders with a stationary indicator 102 and mobile supporting surface 101. As indicated in broken lines, the driving means 103 is connected with the supporting surface 101 in such copyholders. The driving means 103 comprises an electric motor and a transmitting mechanism between the motor drive and the indicator 102. The electric motor may be a suitable fractional-horsepower motor, by way of example a synchronous, stepping or direct-current motor, and the transmitting mechanism is provided with e.g. a conveyor belt to which the indicator 102 is attached. An embodiment of a driving means is discussed below with reference to FIGS. 2, 3.

The driving means 103 is started and stopped by the control unit 104. During operation the indicator 102 is advanced by a length proportionate to the time of operation. It is expedient for the driving means 103 to be supplied by the control unit 104 with current also suitable for the electric motor, by way of example AC, pulsating or DC current. Connected to the control unit 104 are a first and a second actuating means 105 and 106 respectively. The actuating means 105, 106 are designed e.g. as pedal or manual keys, but a key common for both actuating means may be provided. When the actuating means 105 or 106 is operated, a starting order is transmitted to the control unit 104 which then starts the driving means 103.

The control unit 104 is further connected with the stopping device 107. The stopping device 107 is designed for automatic generation and issuance of stopping orders to the control unit 104 for stopping the driving means 103. More particularly, the stopping order is automatically generated whenever the indicator 102 during its advance reaches a place of the copy 101, e.g. a line, to be indicated.

In the present embodiment the stopping device 107 incorporates a timer which may be designed e.g. as a timing relay, timing member, comparative or time-lag switch. The stopping device 107 furthermore comprises a preselection regulator 108 for the manual setting of the timing control. In another embodiment the stopping device 107 comprises, instead of a timing control and preselection regulator 108, a scanning member attached to the indicator which automatically triggers the stopping order whenever the advancing indicator 102 passes e.g. a line.

The control unit 104 in the present embodiment is designed for passing on the starting order from the first actuating means 105 to the stopping means 107. The incoming starting order sets the timer of the stopping means 107. The control unit 107 is furthermore so designed that the stopping means 107 remains ineffective when the second actuating means 106 is actuated. In that case the stopping order is generated when actuation of the second actuating means 106 is terminated.

The copyholder may thus be operated in two ways via the actuating means 105, 106:

In the first mode of operation the first actuating means 105 causes a starting order which starts both the driving means 103 and the timer of the stopping means 107. It is essential that the termination of actuation of the first actuating means 105 does not result in stoppage of the driving means 103. On the contrary, the driving means 103 remains operative until the stopping means 107 automatically issues the stopping order. The time of operation and, respectively, the length of the indicator advance can be adjusted at will by the preselection regulator 108. The first actuating means 105 need thus be actuated only briefly and triggers an independent indicator advance by the line space predetermined. Accordingly the invention provides a substantial advantage over the known copyholders in which an actuating means must be actuated until the indicator 102 reaches the next line.

The copyholder is operated in the said second mode of actuation via the second actuating means 106. In the second mode of operation the drive is in operation as long as the second actuating means 106 is being actuated.

Although this second mode of operation as known per se, use of the second actuating means 106 in addition to and in combination with the first actuating means 105 offers the advantage that the copyholder is also suitable for copies with irregular linespaces owing to the continuous advance.

Figure 2:
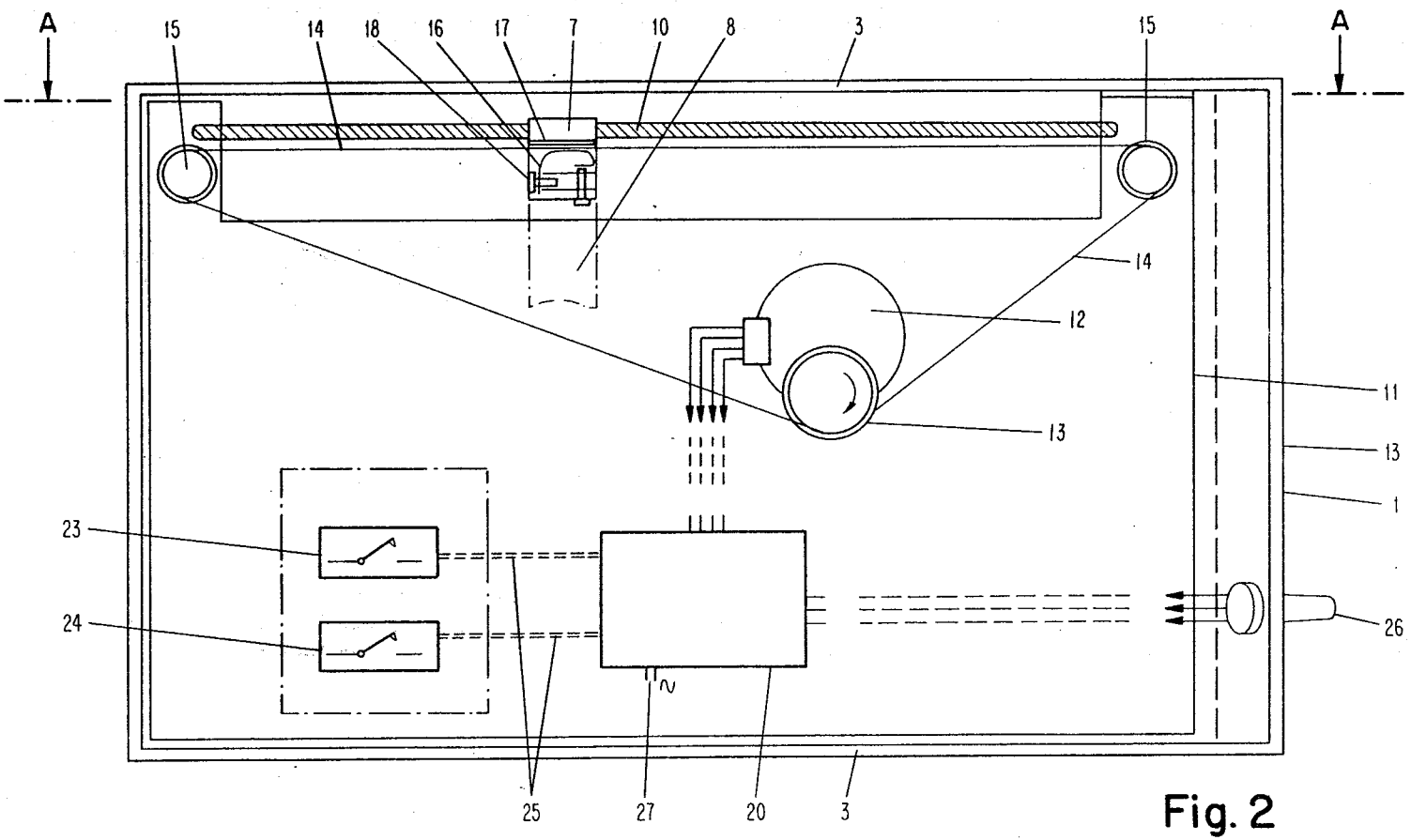
FIG. 2 is a view of the underside of an embodiment of a copyholder.
Figure 3:
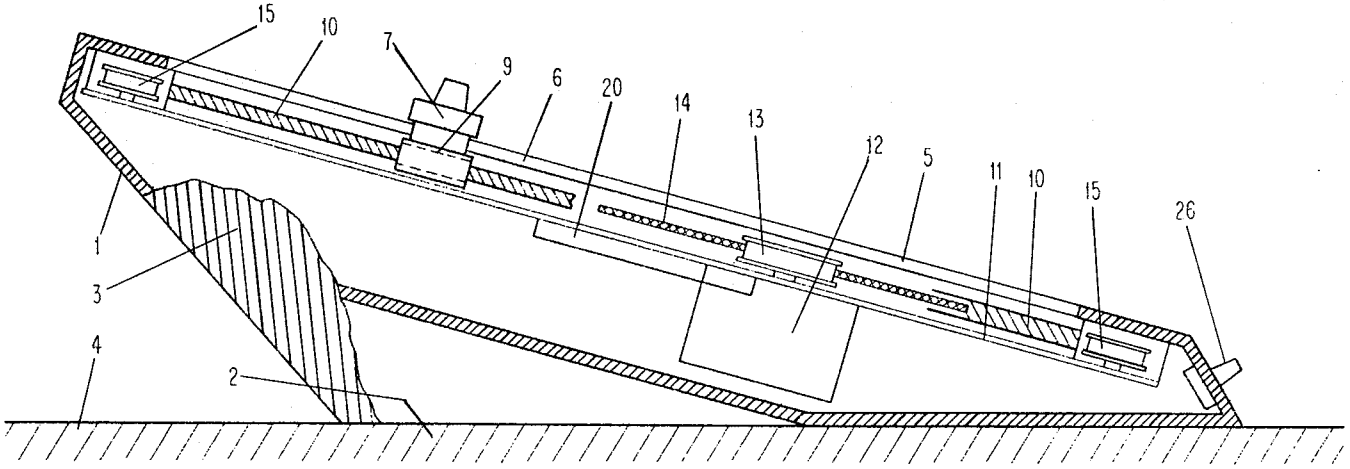
FIG. 3 is a side view of the copyholder along line A-A in FIG. 2.
Figure 4:
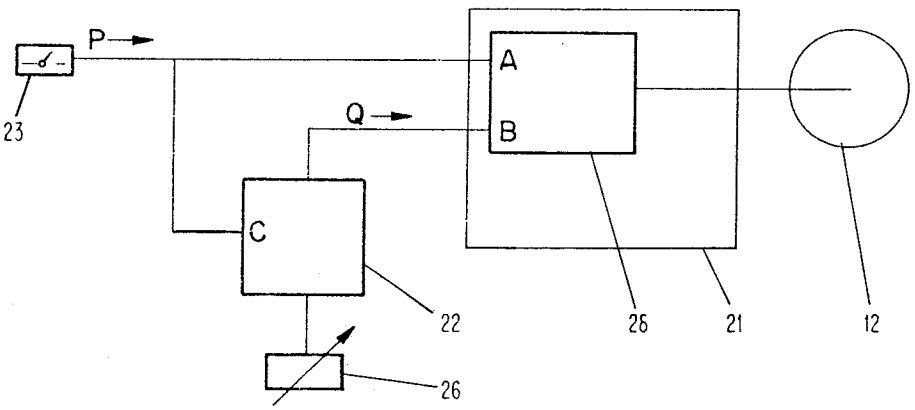
FIG. 4 is a block diagram of parts of the electronic system of the copyholder according to FIG. 2.

The copyholder described may be supplied from the power mains or from a battery. It may further be designed as a stationary desk-type unit or be pivotally attached to a carrier. The copyholder may be employed for any type of copying work, by way of example of typewritten pages or punched cards as well as for reader training. A number of embodiments are described in greater detail with reference to FIGS. 2 through 8. The copyholder according to the embodiment of FIGS. 2 through 4 is designed as a desk-type holder 1 and has the edges 2 of the angular parallel sides 3 stand on the horizontal support 4. The copy is fastened to the supporting surface 5 in the known manner. In another embodiment the copyholder may also be pivotally mounted on a stand.

Along one of its edges the supporting surface 5 is broken by a guide slot 6 in which the slide 7 is displaceably arranged. Interchangeably clamped to the slide 7 is an indicator 8, by way of example a ruler. The indicator 8 is advantageously designed according to the type of the copy to be processed so that the copyholder may be employed e.g. for copying, reading, punching, input and other work. In the case of oblong copies means (not shown) may be provided which enlarge the supporting surface. Through the guide slot 6 the slide 7 engages the interior of the desk 1 and is there slidably borne, through a bore 9, by a rigid guide rail 10 which extends in parallel below the guide slot 6.

The driving means of the embodiment comprises a single-phase synchronous motor 12 with constant speed, an endless belt 14 driven by the synchronous motor 12 and holding means for the attachment to the belt of the slide 7 and thus of the indicator 8. Located inside the desk 1 is a mounting plate 11 on which the synchronous motor 12 is mounted. Via a reduction gear, the synchronous motor 12 drives the endless belt 14 placed around the take-off pulley 13. The endless belt 14 is so suspended by the take-off pulley 13 and a free-wheeling guide pulley at either end of the guide rail 10 that it is moved at a short distance laterally along the guide rail 10. In the present embodiment the endless belt 14 rotates in one direction from left to right, as shown in FIG. 1 corresponding to an indicator advance from top to bottom. Using a reversing gear and motor having two directions of rotation respectively, the endless belt 14 could also be driven in the opposite direction so that the use of a portion of a belt would suffice. In the present example the endless belt 14 is designed as a flat belt, but other belt cross-sections could be employed, or a rope, chain, tooth belt or the like. The attachment of the slide 7 to the endless belt 14 is so designed that no slippage can occur between the slide 7 and the belt 14 during slide advance on the one hand but that, on the other, the slide can be manually displaced on the belt 14 and in the guide slot 6 without much effort when the belt is stationary. In the present embodiment such attachment is effected by a leaf spring 16 accommodated in the slide 7 which forces the endless belt 14 against a ledge 17 of the slide 7. Adjusting screws 18 are provided for adjusting the contact pressure. This design of the attachment of the slide 7 to the belt 14 enables the indicator 8 to be moved into a desired position, by way of example below the first line of the copy to be processed, when the belt is at rest. On the other hand the contact force between the belt 14 and the slide 7 is sufficiently large in operation for the indicator 8 to be moved by a length corresponding to the belt advance. Attachment of the belt 14 to the slide 7 can naturally be modified and is not limited to the manner of attachment described.

Accommodated in the electronic module 20 are the control unit 21 and the stopping means 22. The first and the second actuating means are designed as pedal keys 23, 24 and connected to the module 20 via cables 25. A potentiometer 26 attached to the desk-type copyholder and connected to the module 20 is provided to regulate preselection. The stopping means 22 is designed as e.g. a timing relay and can be adjusted by the potentiometer 26. The control unit 21 and the stopping means 22 cooperate with the pedal keys 23, 24 in a manner described with reference to FIG. 1. A stopping means 22 designed as a timing relay is known and commercially obtainable, e.g. timing relay type AA3 of Swiss firm BACHOFEN AG, which is why the design of the module 20 is not discussed in greater detail. FIG. 4 therefore shows only an exemplifying block diagram of components of module 20 provided for the first mode of operation.

According to FIG. 4 the starting pulse P generated by the first pedal 23 passes, via connection A, into the switching unit 28 of the control unit 21 which starts the driving motor 12 when receiving the starting pulse P and keeps it in operation until a stopping pulse Q reaches the switching unit 28 from the timer 22 via the connection B. The starting pulse P furthermore passes into the timer 22 via the connection C, starting it at the same time as the synchronous motor 12 is started by the switching unit 28. Brief depression of the first pedal key 23 thus operates the copy-holder in the said first mode of operation. The indicator 8 is advanced by constant line spaces, the indicator 8 automatically continuing its advance to the desired position despite the fact that the first pedal key 23 has been released, and remains in that position until the next brief depression of the key occurs. The potentiometer 26 is used to set the time lag between the starting order P and the stopping order Q in the timer 22. It will be recognized that, owing to the constant rate of rotation of the synchronous motor 12, the belt length advanced and thus the indicator advance are proportional to the time set. The timer 22 is e.g. so designed that maximal indicator advances of e.g. 2 cm are effected when the potentiometer 26 is opened to its stop. Returning the potentiometer 26 enables the advance length to be set between zero and maximal advance length. The potentiometer 26 is preferably equipped with a graduated scale with millimeter and typewriter space and other advance length divisions frequently encountered in copy. In addition, it makes possible fine adjustment between such advance lengths.

It is obvious that the first mode of operation is particularly convenient in processing copy, by way of example manuscripts, having constant line spaces since a single setting of the potentiometer 26 per copy will be sufficient. On the other hand the indicator advance to a line of a differently spaced manuscript portion may be effected in the said second mode of operation by actuation of the second pedal key 24. If desired, the second pedal key 24 may be replaced by a switch associated to the first pedal key 23 and attached to the housing for switching line advance operation into continuous operation. A number of further embodiments will now be briefly discussed.

Figure 5:
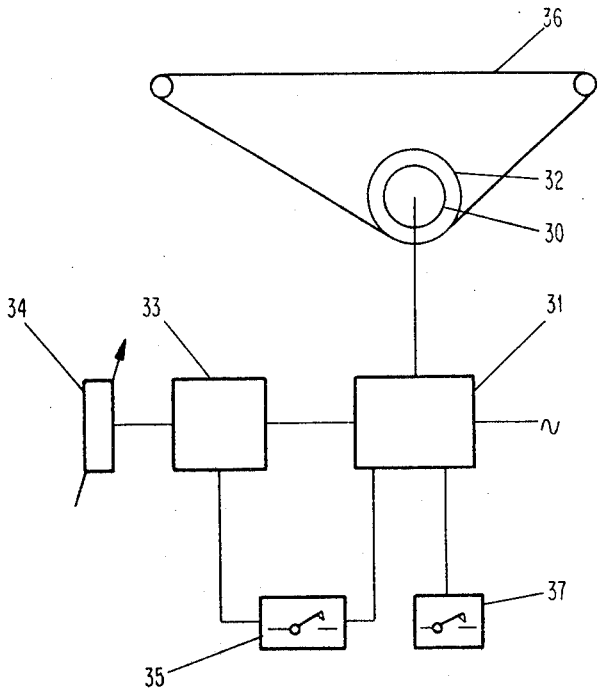
FIG. 5 is a diagrammatic view of an embodiment of a copyholder with a stepping motor.

In the embodiment according to FIG. 5 the driving means is provided with a stepping motor 30 instead of a synchronous motor. In this case the control unit 31 comprises a pulse generator which feeds an adjustable number of pulses into the stepping motor 30. The geared-down take-off pulley 32 of the stepping motor 30 then describes an angle of rotation which is proportional to the number of pulses. For the purpose of setting the number of pulses the stopping means 33 comprises a counting member which automatically terminates the sequence of pulses of the control unit after a certain predetermined number of pulses.

The stopping means 33 furthermore comprises a manually set preselection regulator 34 by means of which the counting member and thus the number of pulses is set before operation starts. The scale of the preselection regulator 34 is naturally graduated in advance lengths. As the actuating means, by way of example the pedal switch 35, is briefly actuated, the pulse generator of the control unit 31 and the counting member of the stopping means 32 are simultaneously rendered operative. The angle of rotation of the take-off pulley may be transmitted to the indicator via an endless belt 36 in a manner similar to that previously described. The key 37 is provided for introducing the second mode of operation which is independent of the stopping means 33.

Figure 6:
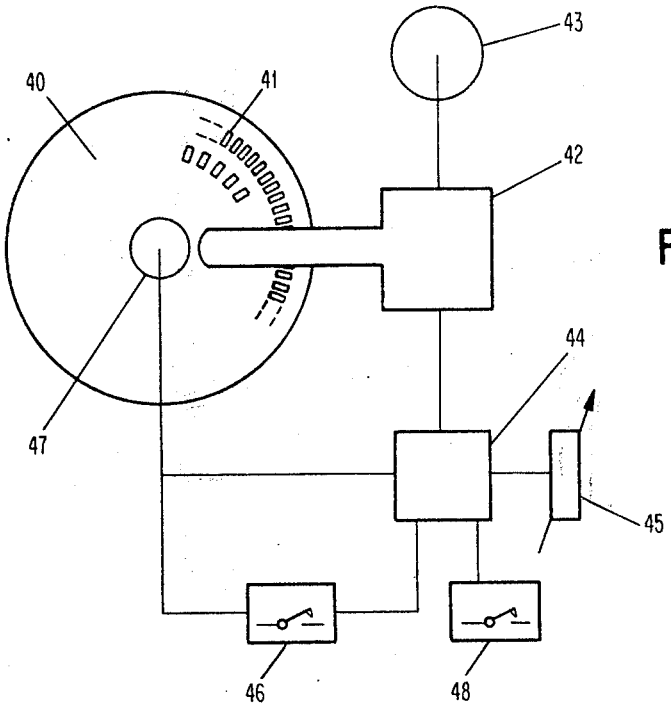
FIG. 6 is a diagrammatic view of an embodiment similar to that shown in FIG. 5.

The principle of the embodiment according to FIG. 6 corresponds to that of the preceding embodiment. A rotating disc 40 is provided as a pulse generator which presents a plurality of holes 41 through the disc face which are distributed over the circumference and arranged in at least one series. An electro-optical scanning member 42 of known design arranged on the perimeter of the disc 40 converts the number of the holes 41 passing the scanning member 42 into a corresponding sequence of electrical pulses. The scanning member 42 feeds the pulse sequence into both the stepping motor 43 of the driving means and the stopping means 44. As previously described with reference to FIG. 5, the stopping means 44 comprises a counting member which is set for a desired number of pulses by the preselection regulator 45 prior to the start of operation. Brief actuation of the first actuating means 46 puts both the counting member of the stopping means 44 and the drive 47 for the disc 40 into operation. The stopping means 44 automatically stops the drive 47 for the disc 40 and thus the stepping motor 43 when the pulse number set has been reached. If the second actuating means 48 is actuated, the disc 40 will rotate as long as actuation lasts and stop at the next hole 41.

Figure 7:
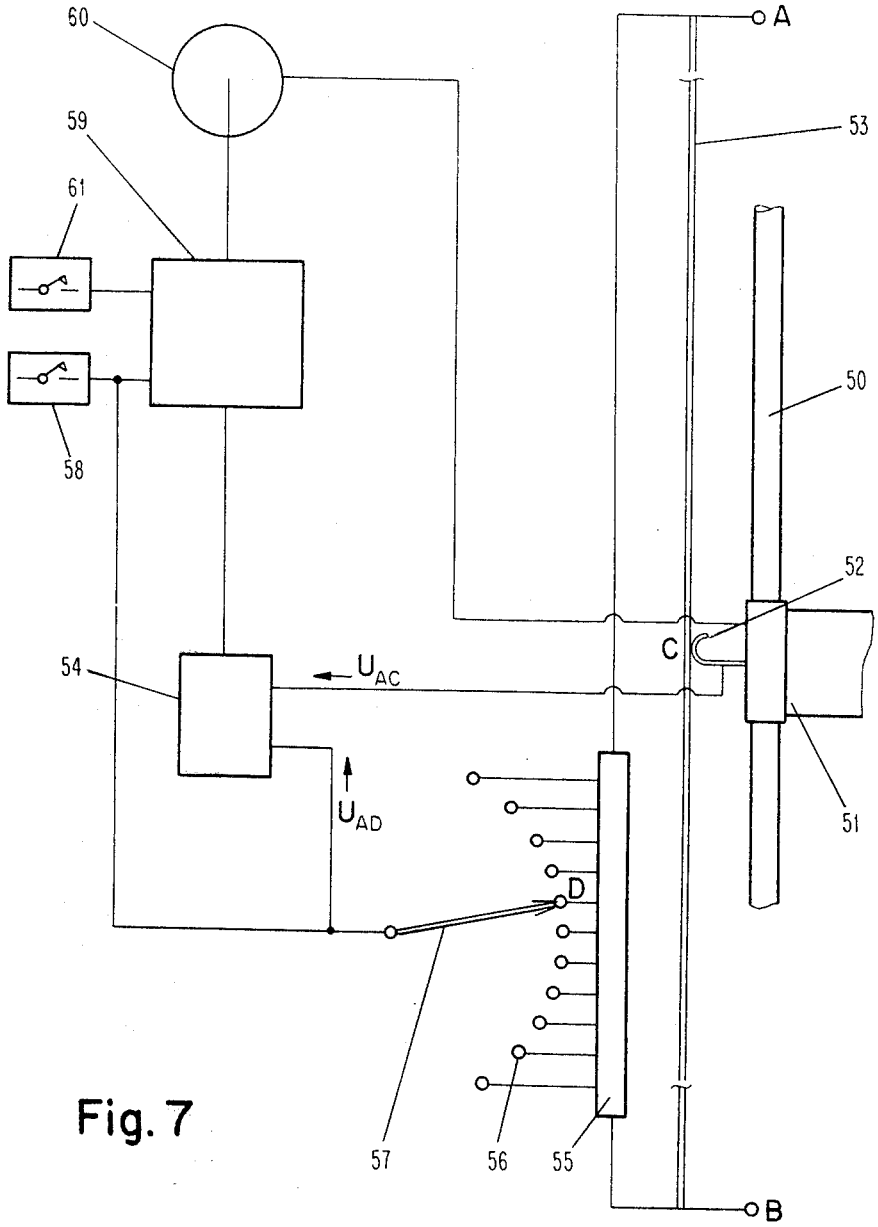
FIG. 7 is a diagrammatic view of a further embodiment of the copyholder.

In the embodiment of the copyholder according to FIG. 7 the stopping means is designed with an electrical voltage divider and a voltage comparing circuit. A preselected rated value is automatically compared with an actual value in the voltage comparing circuit. The rated value corresponds to the desired advance length of the relative movement and the actual value is derived from the position of the indicator at the specific time. If the two values are identical, the voltage comparing circuit issues a stopping order to the control unit.

In the embodiment according to FIG. 7 the voltage divider is designed as a bridge circuit. The slide 51 of the indicator arranged on the guide rod 50 is equipped with a sliding contact 52 which slide along the resistor 53. Applied to the resistor 53 between A and B is a suitable voltage $U_{AB}$. The actual value $U_{AC}$ is tapped between A and the sliding contact 52 and supplied to the voltage comparing circuit 54. The voltage $U_{AB}$ is also applied to a step resistance 55 with a plurality of consecutive tapping points 56. The rated value voltage $U_{AD}$ is consecutively fed into the voltage comparing circuit 54 by the taps 56 by means of the change-over switch 57. The change-over switch 57 may be of the electronic, electromagnetic or electromechanical type. In operation, brief actuation of the first actuating means 58 generates a starting order for the motor 60 of the driving means in the control unit 59. At the same time the control unit 59 places the contact finger of the change-over switch 57 on the next tap 56 of the step resistor 55. The driving means moves the slide 51 until voltage equality $U_{AC} = U_{AD}$ is obtained. The advance length of the slide depends on the resistance values between the taps 56. For variation of the advance lengths several planes with a different number of taps 56 may e.g. be provided, or the change-over switch may contain several contact fingers which contact only a selection of taps 56. The second actuating means 61 is provided for the said second mode of operation independently of the stopping means described. The embodiment according to FIG. 7 is not limited to the use of a voltage divider. It is only essential that the indicator 51 has associated therewith a member which supplies an actual-value signal analogous to the position of the indicator 51, that the stopping means 54 furthermore cause a comparison of that actual-value siganl with a predetermined rated-value signal and gives the stopping order when the actual and the rated values correspond.

Figure 8:
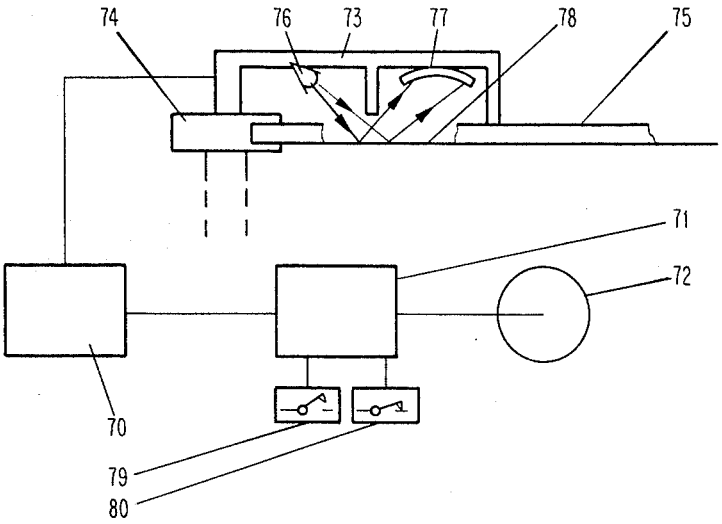
FIG. 8 is a diagrammatic view of yet another embodiment of the copyholder.

The further embodiment of the copyholder according to FIG. 8 now referred to enables automatic line advance to be effected without previous selection of the advance length. The stopping means 70, which automatically issues a stopping signal to the control unit 71 for the motor 72 of the driving means, comprises a scanning member 73 which is fitted to the indicator 75 or the slide 74 and follows its movement. The scanning member 73 carried along consists, by way of example, of a light source 76 which lights the surface of the manuscript 78 and a light-sensitive member 77 arranged closely adjacent to it which receives the light reflected from the surface. The stopping means 70 may be so adjusted that a stopping order for the driving motor 72 is supplied when the light quantity reflected by the unlettered surface of the manuscript is reduced a certain minimal degree at the passage of a lettered or printed line. Line advance thus requires only brief actuation of the first actuating means 79. When the second actuating means 80 is actuated, the scanning member 73 is inoperative.

The electro-optical scanning device operating on reflected light and described in the foregoing may be replaced by scanning that operates on some other principle. By way of example, lighting from the underside may be applied to light-transmitting copy and the scanning member may respond to the screening of a lettered line. Other scanning methods are also possible, by way of example methods operating with magnetic effects on a scanning member, the copy employed naturally requiring appropriate preparation. What is essential is only that a scanning device is connected to the indicator which scanning device supplies a stopping order when a lettered or printed line is passed.

What is claimed is:

1. A copyholder comprising an indicator extending transversely over a copy surface, means for effecting movement of said indicator relative to said copy surface, said means including electrical driving means, a control unit for effecting operation of said electrical driving means, a first actuating means for initiating actuation of said control unit and stopping means for automatic delivery of a stopping signal to said control unit for stopping said driving means, so that said indicator is moved an adjustable predetermined length for each actuation of said first actuating means, a second actuating means for initiating actuating signals to said control unit independent of said first actuating means and stopping means so that said indicator is moved continuously upon each actuation of said second actuating means until termination of actuating signals therefrom, means for attaching said indicator to said belt so that the indicator is advanced by said driving means, a guide slot in a supporting surface for said copy surface, a rigid guide rod arranged underneath said guide slot, and a slide slidably arranged on said guide rod and extending through said guide slot and clamping onto said indicator, a leaf spring disposed in said slide and adjusting means for forcing said belt against said slide under the force of said leaf spring, and a guide pulley disposed at either end of said guide rod and a geared down drive-pulley disposed intermediate said guide pulleys, said belt passing over both of said guide pulleys and said drive-pulley.

2. A copyholder comprising an indicator extending transversely over a copy surface, means for effecting movement of said indicator relative to said copy surface, said means including electrical driving means, a control unit for effecting operation of said electrical driving means, a first actuating means for initiating actuation of said control unit and stopping means for automatic delivery of a stopping signal to said control unit, a second actuating means for initiating and stopping actuation of said control unit independent of said first actuating means and stopping means, means for supplying an actual-value signal analogous to the position of said indicator associated with said indicator, means for supplying a predetermined rated-value signal, and means associated with said stopping means for comparing said actual-value signal supplied by said actual-value signal supplier with the predetermined rated-value signal for issuing a stopping order if said actual-value and said rated-value correspond.

3. A copyholder as recited in claim 2 further comprising a tap of an electric voltage divider coupled to said indicator so that the analogous actual values correspond to the positions of said indicator, and wherein said stopping means comprises voltage comparing circuit means for comparing a predetermined rated value with the actual value and automatically issuing a stopping signal when said actual value and rated value are equal.

4. A copyholder as recited in claim 3 wherein said control unit includes both means for starting said driving means and means for advancing a preselector for said rated value by one step upon receipt of a starting signal from said first actuating means, and wherein said means for advancing a preselector comprises an electric voltage divider designed as a resistor with a tapper, and a preselector designed as a step resistance with a plurality of individually adjustable taps, said resistor forming a bridge circuit with said step resistance and one tap for said actual value and the other tap for said rated value being connected to said voltage comparing circuit means.

5. A copyholder comprising an indicator extending transversely over a copy surface, means for effecting movement of said indicator relative to said copy surface, said means including electrical driving means, a control unit for effecting operation of said electrical driving means, a first actuating means for initiating actuation of said control unit and stopping means for automatic delivery of a stopping signal to said control unit for stopping said driving means, so that said indicator is moved an adjustable predetermined length for each actuation of said first actuating means, a second actuating means for initiating actuating signals to said control unit independent of said first actuating means and stopping means so that said indicator is moved continuously upon each actuation of said second actuating means until termination of actuating signals therefrom, and said driving means comprising a stepping motor, and said control unit comprising a pulse generator for feeding a sequence of pulses to said stepping motor, and said stopping means comprising a counting member and a manually adjustable preselecting regulator for adjusting the counting member so that the counting member automatically terminates the pulse sequence pursuant to a pulse number set on said preselecting regulator prior to the start of operation, and said pulse generator including a rotating disc having a plurality of holes distributed along the circumference thereof and extending therethrough, an electro-optical scanning member arranged on the perimeter of said disc for converting the number of holes scanned into a proportional number of electric pulses, and a drive for said disc which can be stopped by said counting member of said stopping device.

6. A copyholder comprising an indicator extending transversely over a copy surface, means for effecting movement of said indicator relative to said copy surface, said means including electrical driving means, a control unit for effecting operation of said electrical driving means, a first actuating means for initiating actuation of said control unit and stopping means for automatic delivery of a stopping signal to said control unit for stopping said driving means, so that said indicator is moved an adjustable predetermined length for each actuation of said first actuating means, a second actuating means for initiating actuating signals to said control unit independent of said first actuating means and stopping means so that said indicator is moved continuously upon each actuation of said second actuating means until termination of actuating signals therefrom, said stopping means including an electro-optical scanning member attached to said indicator for movement with said indicator and for delivering a stopping signal to said control unit when a line of copy on said copy surface is reached, and said electro-optical scanning member including a light generator for illuminating said copy and a light receiver for receiving light reflected from said copy, a stopping signal being issued when the quantity of light reaching said light receiver falls below a predetermined light level, determined by a predetermined light level determining means.

* * * * *